US006050329A

United States Patent [19]

Durian et al.

[11] Patent Number: 6,050,329

[45] **Date of Patent: *Apr. 18, 2000**

[54] COOLING FIN WITH REINFORCING RIPPLES

[75] Inventors: Stewart William Durian, Waukesha; Stephen Durian, Shawano, both of Wis.

[73] Assignee: McGraw Edison Company, Houston, Tex.

[ * ] Notice: This patent is subject to a terminal disclaimer.

[21] Appl. No.: 09/336,770

[22] Filed: Jun. 21, 1999

[51] Int. Cl.[7] ..... H01F 27/12

[52] U.S. Cl. ..... 165/132; 165/177; 165/906; 165/104.33

[58] Field of Search ..... 165/132, 177, 165/170, 104.33, 906

[56] References Cited

U.S. PATENT DOCUMENTS

| | | | |
|---|---|---|---|
| 1,816,111 | 7/1931 | De Ferranti et al. . | |
| 2,017,201 | 10/1935 | Bossart et al. . | |
| 2,819,731 | 1/1958 | Louthan | 165/177 X |
| 3,119,446 | 1/1964 | Weiss | 165/170 |
| 4,209,064 | 6/1980 | Cacalloro et al. . | |
| 4,413,674 | 11/1983 | Avery et al. . | |
| 4,556,758 | 12/1985 | Warden . | |
| 4,745,966 | 5/1988 | Avery . | |
| 5,894,884 | 4/1999 | Durian et al. | 165/132 |

FOREIGN PATENT DOCUMENTS

| | | | |
|---|---|---|---|
| 649870 | 2/1951 | United Kingdom | 165/177 |

OTHER PUBLICATIONS

Metal fab, Inc. Enclosures for Transformers Catalog, undated.

Menk Apparatebau GMBH Catalog, dated Jul. 1984.

Menk Corrugated Oil Tank Catalog, undated.

Heinrich Georg, GMBH Production Lines for Corrugated Tanks and Casings Catalog, undated.

*Primary Examiner*—Allen Flanigan
*Attorney, Agent, or Firm*—Fish & Richardson P.C.

[57] ABSTRACT

A liquid-filled cooling fin generally includes two roughly rectangular opposing fin walls separated by a relatively thin liquid space or chamber. In this invention the fin walls have reinforcing ripples to increase fin wall rigidity and resistance to deformation. The opposing walls are sealed at both ends along the depth of the fin and at one of the two edges along the height of the fin. The second, open edge of the fin is attached along the height of the fin in a liquid tight seal to a tank in which a transformer or other heat generating device to be cooled is submerged in a cooling fluid. The tank is provided with holes or other fluid passages so that cooling fluid can circulate between the tank and the fin. Cooling fluid is heated in the tank by the transformer and flows from the tank to the cooling fins, where it is then cooled by transferring heat through the fin walls to ambient air. The cooled cooling fluid then circulates back to the tank, completing a circulation pattern which is continuously repeated in operation.

39 Claims, 6 Drawing Sheets

COOLING FIN WITH REINFORCING RIPPLES

CROSS REFERENCE TO RELATED APPLICATIONS

1. Technical Field

The invention relates to a cooling fin for dissipating heat from cooling fluid heated by an electrical transformer or other device.

2. Background

Electric transformers and other devices generate potentially harmful heat in normal operation. Typically, these devices are located within a tank filled with a cooling fluid in which the device is submerged and which transfers heat away from the device. To increase the heat dissipation from the tank, the tank may be provided with an additional heat transfer surface, such as a radiator, heat exchanger, or cooling fin for transferring heat from the cooling fluid to ambient air.

Cooling fins generally include two, roughly rectangular, opposing fin walls separated by a relatively thin liquid space. The walls are sealed together along the short sides of the fin and at one of the long sides (the "nose" of the fin). The second open edge of the fin, generally known as the fin "root" or base, is attached in a liquid tight seal to the transformer tank. The tank is provided with holes or other fluid passages so that cooling fluid can circulate between the tank and the fin.

The liquid-filled cooling fins may vary in size and structural configuration depending on the amount of heat produced by the device, the ambient temperature, and characteristics of the cooling fluid. Cooling fluid is heated in the tank by the device and flows from the tank to the cooling fins, where it is then cooled by transferring heat through the fin walls to ambient air. The cooled fluid then circulates back to the tank, completing a circulation pattern which continuously repeats.

The cooling fluid expands when heated so that the pressure inside the tank and the cooling fins increases as the cooling fluid temperature increases. It is important to device operability that the fins be capable of withstanding the increased pressure due to the heating of the cooling fluid. For a given tank size, larger liquid-filled fins are used to increase the heat dissipation. As the fin size increases, the cooling fluid pressure at which the fin deforms decreases. For example, it is known from practice and experimentation that plain-wall 14 gage steel liquid-filled cooling fins 54 inches high and 10 inches deep begin to permanently deform at pressures between 7 psig and 10 psig. For this reason, fins larger than approximately 54 inches high and 10 inches deep generally have not been used because they exhibit unacceptably high deformation at fluid pressures of approximately 7 psig. The pressure withstand capability of liquid-filled cooling fins thus limits the maximum height and depth of a fin that can be used on a tank.

Attempts to increase fin size and heat dissipation capacity have generally used fins that are more complicated in design and construction to withstand the cooling fluid pressure. For example, fins including extensive troughs or dimples generally employ numerous spot welds between opposing fin walls, and consequently are more expensive to manufacture than plain wall fins.

The primary mode of fin deformation is by an increase in the fin thickness in the form of outward "ballooning" of the opposing fin walls. The fin experiences two modes of failure from deformation due to pressure loading. The first mode is permanent deformation of the fin walls such that the fin walls do not return to their originally manufactured shape and size after removal of the pressure load. The second mode is catastrophic failure, in which the fin deforms sufficiently to cause excess loading of welded connections and weld failure, typically at the ends of the fin. As noted, fins have been strengthened by mechanical fastening of the two opposing fin walls at locations between the fin ends and between the fin nose and root. For example, it is known to reinforce the fin by spot welding the opposing walls of the fin together in the presence of formed dimples or troughs. This mechanical fastening requires matching indentations in the opposing fin walls that are to be fastened together. Mechanically fastened fins are more costly, more difficult to form and manufacture, and can result in the formation of weak points and leaks in the fin walls. Further, fabricating extensive troughs or dimples in the fin wall can distort the fin, leading to a poor fit to the transformer tank.

The pressure withstand capability of large fins may also be increased by manufacturing fins of heavier gage or higher strength materials. These approaches result in higher material costs as well as higher fabrication costs.

SUMMARY

A liquid-filled cooling fin may include reinforcing ripples formed in opposing walls of the fin to increase the pressure withstand capability of the fin without mechanical fastenings internal to the fluid chamber formed by the opposing fin walls. As defined herein, "ripples" may include, for example, ripples or corrugations having angled (such as a sawtooth) or curved (such as a sine wave) cross-sections.

Multiple fins may be formed or joined together to form a fin bank. One or more fin banks may then be attached to a cooling tank. Holes may be cut into the tank wall between the opposing fin walls at points corresponding to the fin locations to allow cooling fluid to circulate between the tank and the fins. Alternatively, fin banks may themselves form the tank wall through attachment to a framework to form a liquid-tight tank.

The reinforcing ripples increase the rigidity of the fin walls, which reduces the deformation of the fin wall under higher cooling fluid pressure loads and, in turn, reduces the stresses in the fin wall material and points of joinder. The ripples thus allow the use of larger fins, with greater heat dissipation, in a variety of applications including transformer tank cooling.

The rippled fins exhibit an increased ability to withstand pressure relative to prior fins. The fins exhibit less deformation, (i.e., "ballooning"), of the opposing fin walls at a given cooling fluid pressure. Further, fins are commonly manufactured with end crimps. Ripples allow such fins to withstand higher cooling fluid pressures without catastrophic failure of the end crimps. The ripples thus allow the use of larger fins, such as fins with a height of 60 inches or more and a depth of 12 inches or more, for increased heat dissipation under cooling fluid pressures of 7 psig or greater.

Another advantage of the rippled cooling fins is that the cost of material and manufacturing for such fins is lower than that of fins with improved pressure withstand capability produced by using dimples, troughs, thicker walls, or stronger materials. Excessive manufacturing time and fabrication cost is avoided because extensive spot welding is not required. Forming the reinforcing ripples into the fin wall surfaces avoids the complications associated with fins with mechanical fastenings between the opposing walls, and also avoids the risk of leakage and catastrophic failure of spot welds between opposing walls.

The increased pressure withstand capability of the rippled fins is achieved without the need for heavier gage or higher strength fin wall materials, thus avoiding the increased cost associated with these approaches. The rippled fins can achieve equivalent rigidity to a cooling fin with reinforcing ribs, while using less expensive and less strong fin wall materials. Additionally, a good fit between the transformer tank and the fins is easily obtained because the fin wall distortion resulting from the forming of extensive dimples or troughs in the fin walls is avoided.

A further advantage of the rippled fin is that it has improved heat dissipation capacity. This is because the reinforcing ripples increase turbulence in the circulating cooling fluid and the ambient air passing across the fins. The increased turbulence improves the transfer of heat both from the cooling fluid to the inside surface of the fin wall and from the outside surface of the fin wall to ambient air.

In one general aspect, a cooling fin system includes a walled fluid-containing enclosure with a number of fins spaced around the enclosure walls. A particular fin includes a pair of sheet-like parallel walls having edge and end portions secured together to form a liquid tight cavity. At the base of the fin, the fin walls have outturned flanges which connect the fin to the enclosure wall. Reinforcing ripples are impressed into at least one of the fin walls and extend from the inner to the outer edge of the fin. These ripples provide additional rigidity for the fin to better withstand internal fluid pressure.

Embodiments may include one or more of the following features. For example, the reinforcing ripples may allow the fins to withstand fluid pressures of at least seven pounds per square inch without permanent deformation. These ripples may also create turbulence in the circulation of the cooling fluid and the flow of the ambient air to aid in efficient heat exchange.

The system also may include one or more fins having walls separated from each other throughout their entire interior space. The fins may have a minimum depth-to-length ratio of about five.

In another general aspect, a cooling fin includes a pair of sheet-like walls which are substantially parallel and have a peripheral edge and end portions that are secured together to form a fluid tight cavity. The walls are separated from each other and have outturned flanges which extend from the walls at the fin base.

Reinforcing ripples in one, or both, of the fin walls may extend from near the fin base to its peripheral edge. The reinforcing ripples of the cooling fin may protrude outward from the outer surface of the wall. These ripples also may be oriented along longitudinal axes that are substantially perpendicular to the edges of the walls and may be impressed into a majority of the surface of the walls.

A fin may be configured with a peripheral edge portion which is continuous with the walls and with the end portions which are crimped together and welded to form a fluid tight seal.

A fin may have a height which is substantially equal to the length of the peripheral edge portion but is less than 36 inches. Alternatively a fin may be configured in an approximately rectangular shape with a height of 54 inches or more and a depth of 10 inches or more. Peripheral edge portions of the fin may be continuous with the fin walls, and end portions of the fin walls may be crimped and welded together in a fluid tight seal. The fin may have two outturning flanges at its base. The fin may be configured to include an absence of interior fastenings between the walls.

The ripples may extend from near the peripheral edge portion of the fin to near the fin base to provide the fin with greater pressure withstand capability. The reinforcing ripples may be configured with a peak-to-peak dimension of approximately four inches and a peak-to-valley dimension of about three-sixteenths of an inch or more. The fin may also be configured with the ripples aligned to lie substantially perpendicular to the peripheral edge of the fin.

A fin also may be configured with enlarged flow channels by leaving the top and bottom ends of the fin unrippled. On such a fin, the rippling may extend continuously between the two flow channels, and the unrippled flow channels may extend from the top and bottom ends of the fin for about fifteen percent each of the fin height. The fin may have multiple bands of reinforcing ripples.

Other features and advantages will be apparent from the following description, including the drawings, and from the claims.

DETAILED DESCRIPTION

Figure 1:
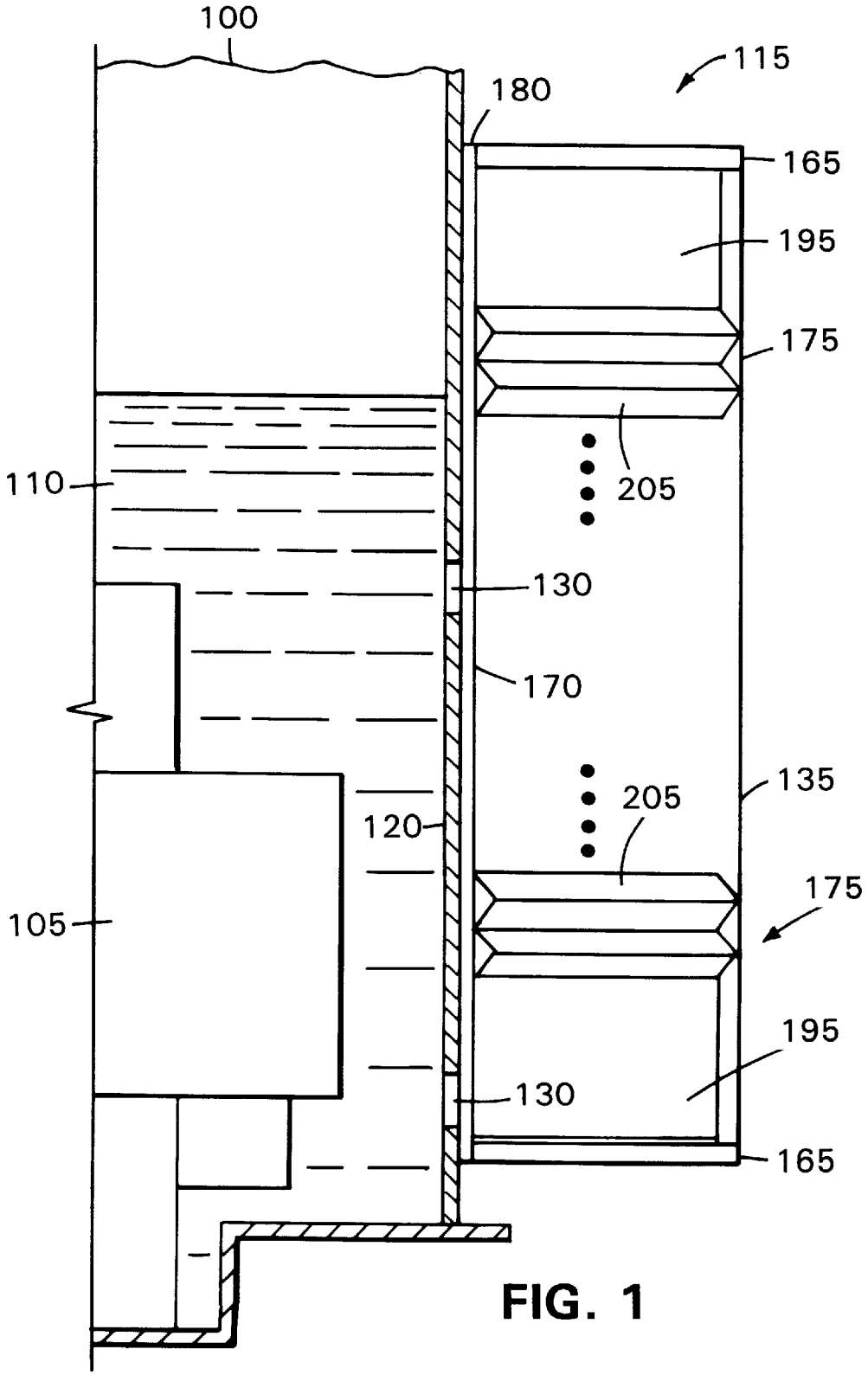
FIG. 1 is an elevational view of a liquid-filled cooling fin with reinforcing ripples, with an associated transformer tank portion shown partially in section.

Referring to FIG. 1, a tank 100 contains a transformer 105 submerged in cooling fluid 110. A liquid-filled cooling fin 115 is attached to an outer wall 120 of tank 100 by, for example, peripherally welding the base 180 of fin 115 to the wall 120 of tank 100 to provide a fluid-tight joint. Holes 130 or other passages (not shown) are provided in the wall for the circulation of cooling fluid 110 between tank 100 and fin 115. Although the following description references multiple fins 115 disposed on the outer wall 120 of the tank 100 and having a transformer 105 disposed within the tank, it should be understood that a single fin 115 may be used to dissipate the heat from any heat generating device disposed within tank 100.

Figure 2A:
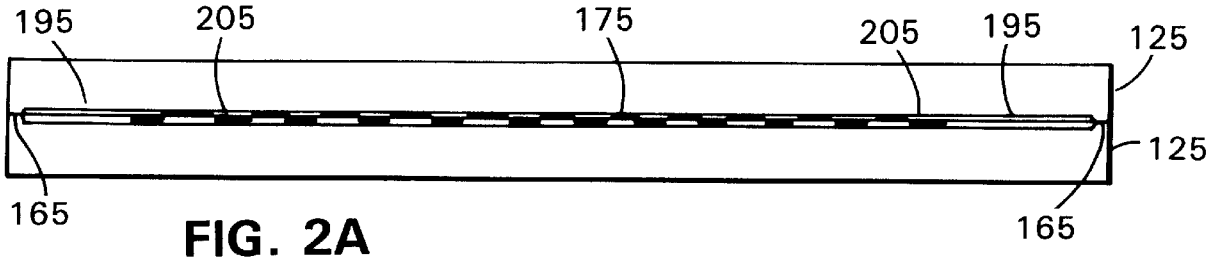
FIGS. 2A–2C are drawings of a cooling fin with reinforcing ripples, with FIG. 2A showing an end view, FIG. 2B showing a side view, and FIG. 2C showing a top view of the fin.
Figure 2B:
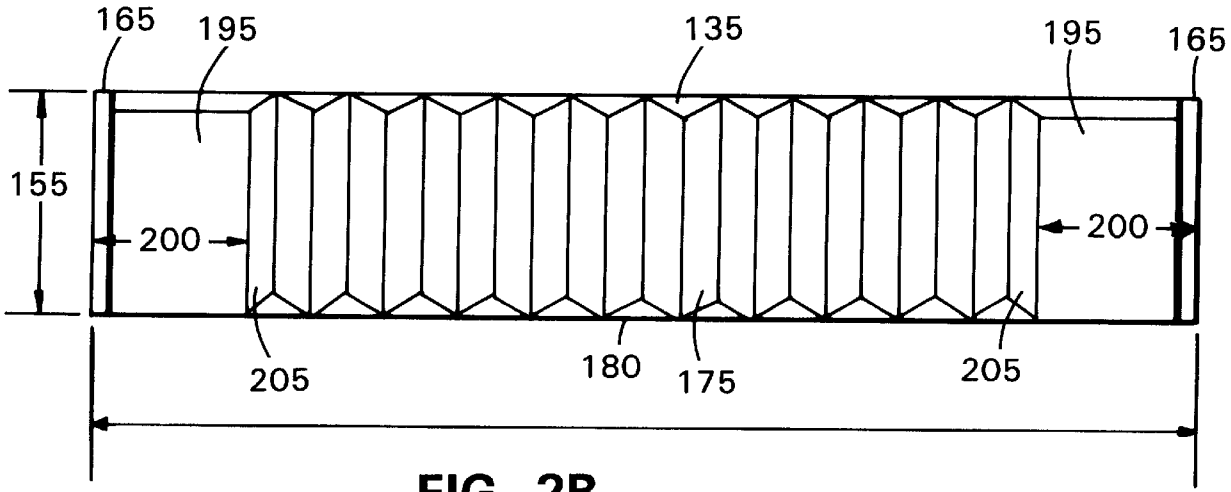
Figure 2C:
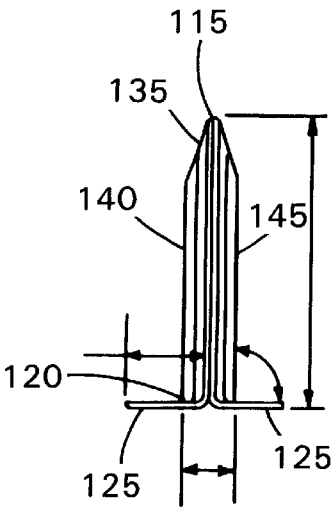
Figure 3:
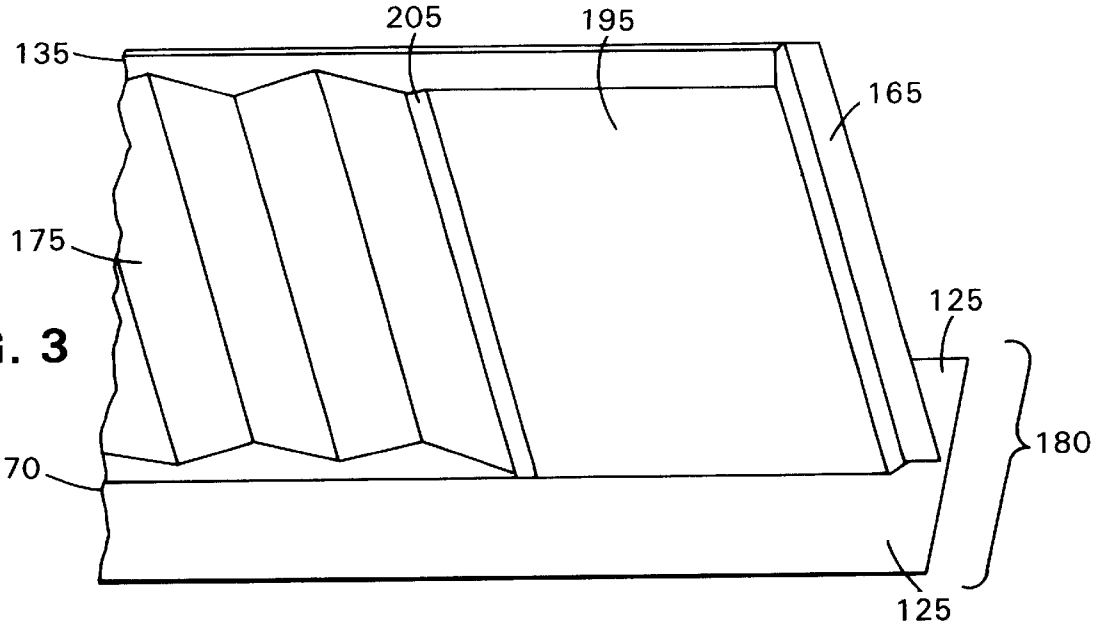
FIG. 3 is a perspective view of the end detail of a cooling fin with reinforcing ripples.
Figure 7:
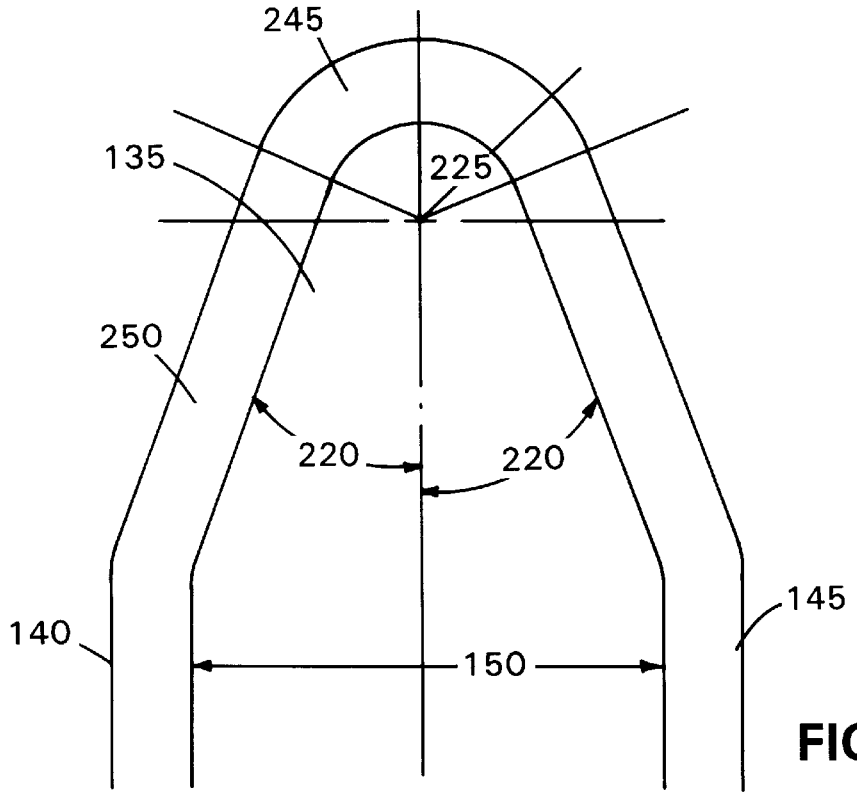
FIG. 7 is a detail view of the nose of a cooling fin with reinforcing ripples taken along section 7—7 of FIG. 5.
Figure 8:
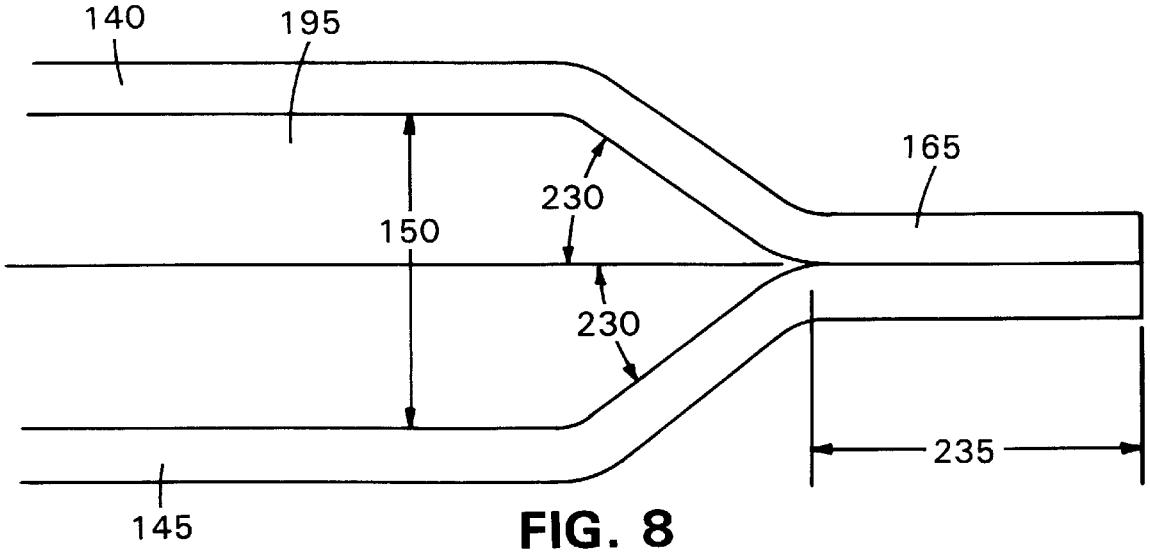
FIG. 8 is a detail view of the edge crimp of a cooling fin with reinforcing ripples taken along section 8—8 of FIG. 5.
Figure 9:
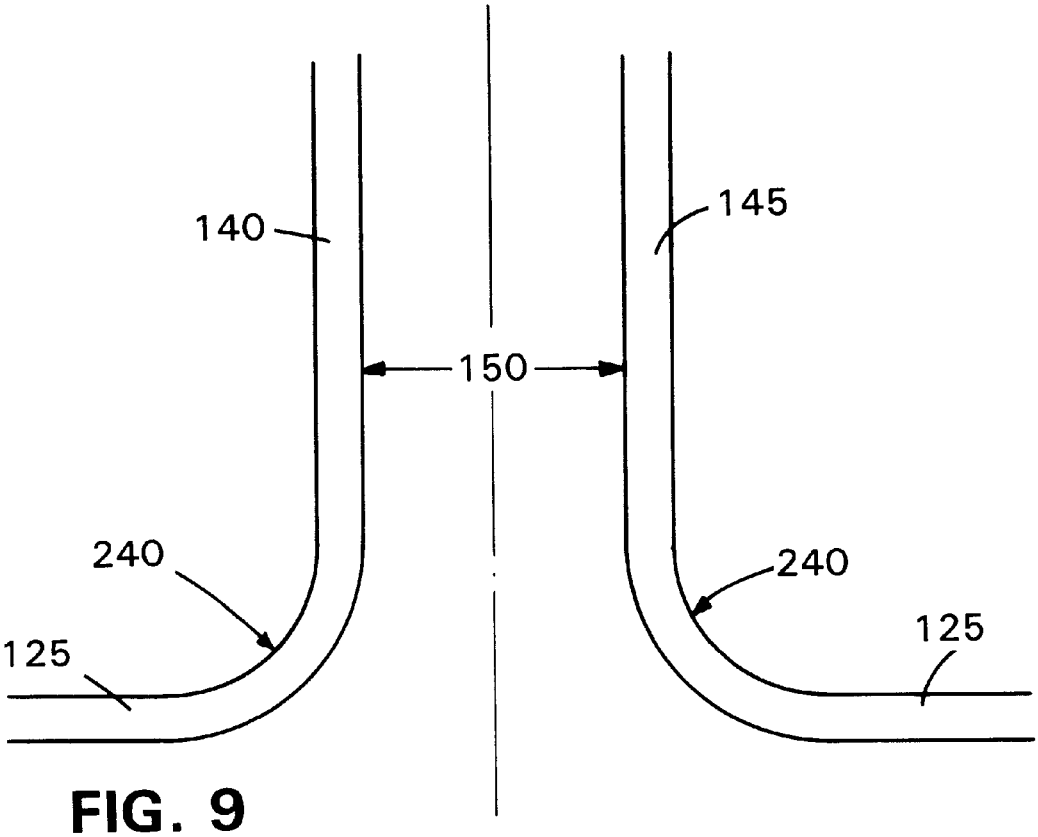
FIG. 9 is a detail view of the base of a cooling fin with reinforcing ripples taken along section 9—9 of FIG. 5 to illustrate the outturned base flanges.

Referring to FIGS. 2 and 7, the cooling fin 115 includes a single sheet of material, preferably sheet steel, formed and bent along nose 135 into two oppositely disposed fin walls 140 and 145. The material is continuous across the nose 135 of fin 115. Fin 115 has fin thickness 150, fin depth 155, and fin height 160. Referring to FIGS. 2–4 and 8, the end crimps 165 are made in the two open ends of the material and then are welded along the edge of the material to form a liquid-tight seal. As shown in FIGS. 2C and 9, the material is flared out along the root 170 of the fin 115 to form the base flange 125 of fin 115.

Reinforcing ripples 175 are formed along most of the opposing fin walls 140, 145. These reinforcing ripples run substantially perpendicular to the fin base 180 and extend substantially from the fin root 170 to the fin nose 135. The reinforcing ripples 175 preferably have a predetermined peak-to-peak dimension 185 and peak-to-valley dimension 190. By varying the peak-to-peak dimension 185 and the peak-to-valley dimension 190 the section modulus of the fin wall may be increased to provide the rigidity needed to maintain fin deformations at desired levels at the service pressure of the cooling fluid 110.

Figure 4:
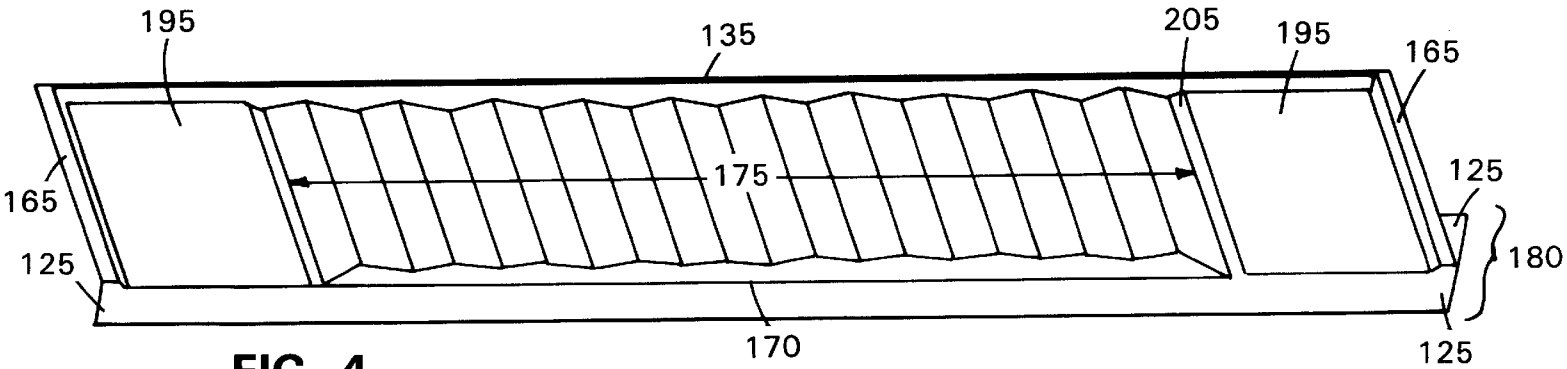
FIG. 4 is a full perspective view of a cooling fin with reinforcing ripples.
Figure 5:
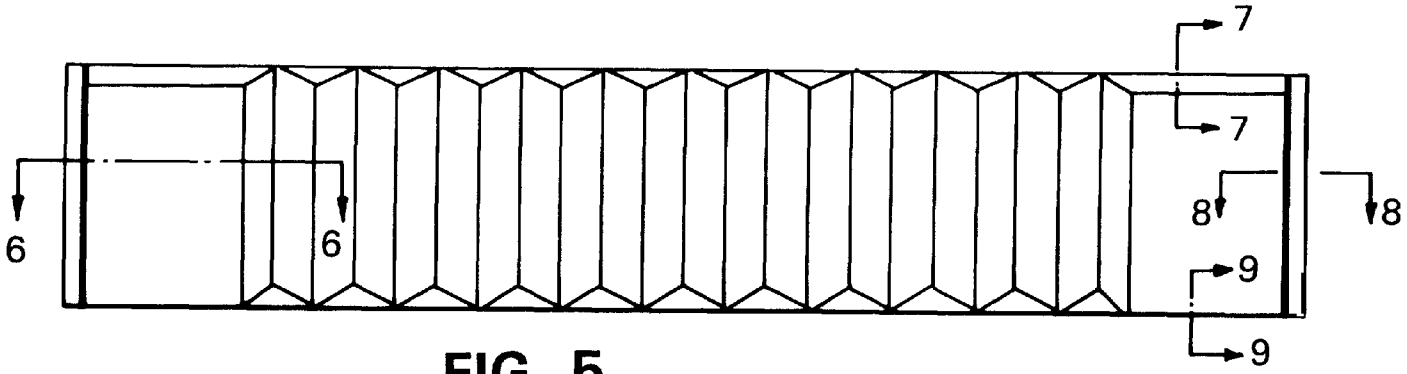
FIG. 5 is a side view of the cooling fin with reinforcing ripples of FIGS. 2A–2C.
Figure 6:
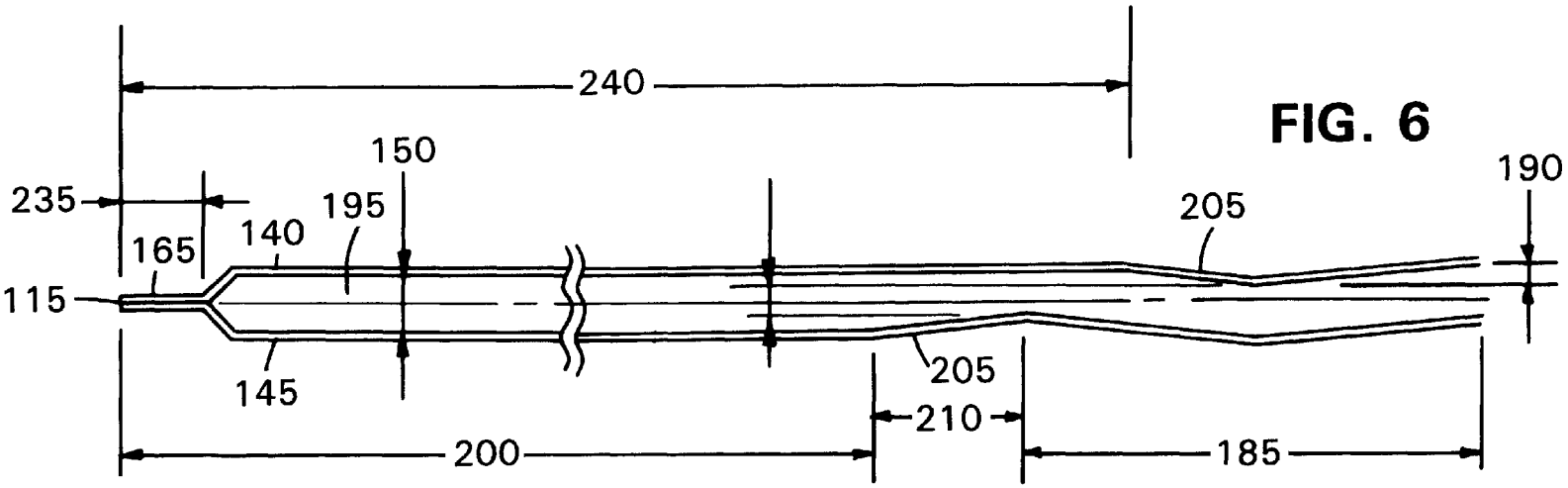
FIG. 6 is a partial view of a cooling fin with reinforcing ripples taken along section 6—6 of FIG. 5.

In one embodiment of the rippled fin, the top and bottom ends of fin 115 are left un-rippled to form enlarged flow channels, or headers 195, which aid internal fluid flow. Referring to FIG. 6, each header is followed, moving inward on fin 115, by a transition edge 205 of dimension 210. In the case of fin wall 140, the transition edge begins at a distance 240 from the fin end. In the case of fin wall 145, the distance is 200. Fin thickness is 150 and the ripples have peak-to-peak dimensions of 185 and peak-to-valley dimensions of 190. As shown in FIG. 4, the reinforcing ripples 175 extend continuously between the two headers with their associated transition edges. FIG. 7 depicts the fin nose in cross section. The nose peak 245 is described by a bend of radius 225. Fin walls 140, 145 extend through transition region 250 at angle 220 from the longitudinal axis. Transition region 250 extends until wall separation 150 is achieved. FIG. 8 depicts a fin end in cross section. End crimp 165 extends distance 235. Following upon crimp 165 fin walls 140, 145 separate at angle 230 from the longitudinal axis but are realigned parallel to the axis once wall separation 150 is achieved. FIG. 9 depicts the cooling fin base in cross section. Fin walls 140, 145 transition into base flanges 125 through perpendicular bends of bend radius 240.

The fin 115 may have a fin height 160 of approximately 60 inches, and a fin depth 155 of approximately 12 inches. The fin thickness 150 is approximately 0.5 inches. Each header 195 is followed, moving inward on fin 115, by a transition edge 205 which extends for approximately 1.3 inches. For this fin size, the transition edges 205 of fin wall 145 begins at approximately 8.7 inches from the top and bottom ends of fin 115. For fin wall 140 the transition edges 205 begin at approximately 10 inches from the top and bottom ends of fin 115. End crimps 165 extend for three-quarters of an inch before transitioning into the headers at a forty-five degree angle. Between the headers 195 and the transition edges 205 on fin wall 145 are ten full ripples 175 with peak-to-peak dimensions 185 of approximately four inches and peak-to-valley dimensions 190 of approximately 0.19 inches. For fin wall 140 there are nine full ripples 175 of identical dimension to those of wall 145. The bend radius of nose peak 245 is approximately 0.094 inches and transition region 250 is at an angle of approximately twenty degrees to the longitudinal axis. The base of fin 115 is composed of two flanges 125 which are formed perpendicular to, and of, fin walls 140, 145 through a bend of an approximate 0.25 inch radius.

Figure 10:
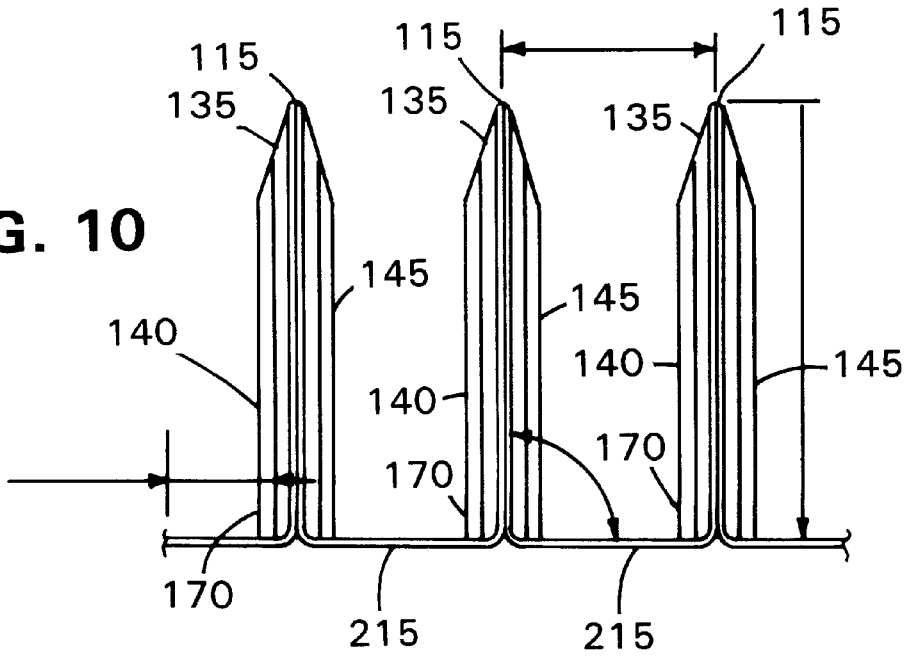
FIG. 10 is a plan view of liquid-filled cooling fins forming a wall of an associated transformer tank.

FIG. 10 illustrates a bank of fins 115. Multiple fins 115 are assembled by aligning the fin base flanges 28 of adjacent fins in edge-to-edge abutment. Adjacent base flanges 28 are then secured together in a fluid tight manner, such as by welds 215. The fin bank may then be secured to the tank wall by, for example, peripherally welding the base flanges 28 of the fins to the tank wall to provide a fluid-tight joint. Alternatively, the fin base flanges 28 may be overlapped and welded rather than butt welded as illustrated in FIG. 10. Alternatively, the tank wall may be made of a fin bank assembled as above by welds 215. The resulting assembly of fins is then attached to a framework (not shown) of the tank to comprise the wall of tank 100. Any number of walls may thus be provided for tank 100, and any number of fins may constitute a given wall.

Other embodiments are within the scope of the following claims.

What is claimed is:

1. A cooling fin system for dissipating heat from a fluid, the cooling fin comprising:

an enclosure having a wall for containing the fluid; and a plurality of fins spaced along the wall, each of the fins comprising:

a pair of substantially parallel, oppositely disposed, sheet-like wall members having facing peripheral edge portions and end portions that are secured together in a fluid tight seal, the said wall members being separated to form a liquid tight cavity, one of the wall members having a first outturned flange along the edge of the wall member opposite the peripheral edge portion, the flange being connected to the wall of the enclosure, the other of the wall members having a second outturned flange extending in a direction opposite the first flange, and reinforcing ripples extending radially from the wall of the enclosure, the reinforcing ripples being impressed into at least one of the wall members and extending from near the peripheral edge portion of the wall member to the edge of the wall member opposite the peripheral edge portion, the reinforcing ripples providing reinforcement to the fin to withstand increasing pressure in the enclosure.

2. The system of claim 1, wherein the wall members are spaced from each other throughout the entire interior portion of the fin.

3. The system of claim 2, wherein the fin includes an absence of mechanical fastening between the reinforcing ripples.

4. The system of claim 2, wherein the reinforcing ripples create increased turbulence in the circulating cooling fluid and the ambient air passing across at least one of the wall members.

5. The system of claim 1, wherein the reinforcing ripples increased turbulence in the circulating cooling fluid and the ambient air passing across the fin.

6. The system of claim 1, wherein a fin has a minimum depth to length ratio of about five to one.

7. The fin of claim 1, wherein the fins withstand fluid pressure of at least seven pounds per square inch without permanent deformation.

8. A cooling fin, comprising:

a pair of substantially parallel, oppositely disposed, sheet-like wall members having facing peripheral edge portions and end portions that are secured together in a fluid tight seal;

the wall members being separated from each other;

one of the wall members having a first outturned flange along the edge of the wall member opposite the peripheral edge portion; and the other wall member having a second outturned flange extending in a direction opposite the first flange;

first reinforcing ripples to add rigidity to at least one of the wall members, the first reinforcing ripples being impressed into at least one of the wall members and extending from near the peripheral edge portion of the wall member to the edge of the wall member opposite the peripheral edge portion;

second reinforcing ripples to add rigidity to the other wall member, the second reinforcing ripples impressed into the other wall member and extending from near the peripheral edge portion of the other wall member to the edge of the other wall member opposite the peripheral edge portion.

9. The liquid filled cooling fin of claim 8, in which the reinforcing ripples protrude outward from the outer surfaces of the wall members.

10. The liquid filled cooling fin of claim 9, in which the reinforcing ripples are disposed along longitudinal axes that are substantially perpendicular to the peripheral edges of the wall members.

11. The liquid filled cooling fin of claim 10, wherein the reinforcing ripples are impressed into a majority of the opposing wall members to add rigidity, the reinforcing ripples extending from near the peripheral edge portions of the wall members to near the outturned flanges of the wall members.

12. The cooling fin of claim 11 wherein the peripheral edge portion is continuous with the wall members.

13. The cooling fin of claim 12 wherein the end portions of the wall members are crimped together and welded to form a fluid tight seal.

14. The cooling fin of claim 9, wherein the fin has a height substantially equal to the length of the peripheral edge portion and less than 36 inches.

15. The liquid filled cooling fin of claim 10, wherein the fin has a height substantially equal to the length of the peripheral edge portion of the wall members and more than 54 inches, and a depth substantially equal to the length of an end portion of the wall members and more than 10 inches.

16. The cooling fin of claim 15, wherein the ripples have a peak-to-peak dimension of approximately four inches.

17. The cooling fin of claim 16, wherein the ripples have a peak-to-valley dimension of approximately three-sixteenths of an inch or more.

18. A system for dissipating heat from a fluid, comprising:

an enclosure having a wall for containing the fluid; and one or more fins circumferentially spaced over the wall, each of the fins comprising:

a pair of substantially parallel, oppositely disposed, sheet-like wall members having peripheral edge portions and end portions;

the wall members being separated and formed to provide a liquid tight cavity;

the base of the fin providing means to connect in a liquid tight seal to the wall of the enclosure; and reinforcing ripples extending from the enclosure, the reinforcing ripples formed into at least one of the wall members and extending from near the peripheral edge portion of the wall member to approximately the edge of the wall member opposite the peripheral edge portion, the reinforcing ripples providing reinforcement to the fin to withstand the fluid pressure.

19. The system of claim 18, wherein each of the one or more fins includes an absence of interior fastening between the reinforcing ripples.

20. The system of claim 18, wherein the reinforcing ripples of the one or more fins create increased turbulence in the circulating cooling fluid and the ambient air passing across at least one of the wall members.

21. The system of claim 18, wherein each of the one or more fins has a minimum depth-to-length ratio of about five to one.

22. The system of claim 18, wherein each of the one or more fins withstands fluid pressure of at least seven pounds per square inch.

23. A liquid-filled cooling fin, comprising:

a pair of substantially parallel, oppositely disposed, sheet-like wall members having peripheral edge portions and end portions;

the wall members being separated and formed to provide a liquid tight cavity;

the base of the fin providing means to connect in a liquid tight seal to the wall of an enclosure;

first reinforcing ripples to add rigidity to at least one of the wall members, the reinforcing ripples formed into at least one of the wall members and extending from near the peripheral edge portion of the wall member to the edge of the wall member opposite the peripheral edge portion;

second reinforcing ripples to add rigidity to the other wall member, the second reinforcing ripples formed into the other wall member and extending from near the peripheral edge portion of the other wall member to the edge of the other wall member opposite the peripheral edge portion.

24. The fin of claim 23, wherein the fin includes an absence of interior fastening between the reinforcing ripples.

25. The fin of claim 23, wherein the reinforcing ripples of the fin create increased turbulence in the circulating cooling fluid and the ambient air passing across the rippled surface.

26. The fin of claim 23, wherein the fin has a minimum depth-to-length ratio of about five to one.

27. The fin of claim 23, wherein the reinforcing ripples withstand fluid pressure of at least seven pounds per square inch.

28. The fin of claim 23, in which the reinforcing ripples are disposed with a longitudinal axis that is substantially perpendicular to the peripheral edge of the wall members.

29. The cooling fin of claim 28, wherein the reinforcing ripples are formed into a majority of the surface of the opposing fin walls to add rigidity, the reinforcing ripples formed into the opposing wall members and extending from near the peripheral edge portions of the wall members to near the fin base.

30. The cooling fin of claim 28, wherein the peripheral edge portion is continuous with the wall members.

31. The cooling fin of claim 28, wherein the end portions of the wall members are crimped together and welded to form a fluid-tight seal.

32. The cooling fin of claim 28, wherein one of the wall members has a first outturned flange along the edge of the wall member opposite the peripheral edge portion and the other of the wall members has a second outturned flange extending in a direction opposite the first flange.

33. The cooling fin of claim 28, wherein the fin has a height substantially equal to the length of the peripheral edge portion and less than 36 inches.

34. The liquid-filled cooling fin of claim 28, wherein the fin is of approximately rectangular shape and has a height of 54 inches or more, and a depth of 10 inches or more.

35. The cooling fin of claim 28, including multiple bands of reinforcing ripples.

36. The cooling fin of claim 29, wherein the ripples have a peak-to-peak dimension of approximately four inches and a peak-to-valley dimension of approximately three-sixteenths of an inch or more.

37. The cooling fin of claim 29, wherein portions of the top and bottom ends of the fin remain unrippled/uncorrugated to form enlarged flow channels.

38. The cooling fin of claim 37, wherein reinforcing ripples extend continuously between the two flow channels.

39. The liquid-filled cooling fin of claim 37, wherein the unrippled flow channels extend from the top and bottom ends of the fin, each for at least about fifteen percent of the fin height.

* * * * *